US011626238B2

(12) United States Patent
Yoshino et al.

(10) Patent No.: US 11,626,238 B2
(45) Date of Patent: Apr. 11, 2023

(54) COIL COMPONENT

(71) Applicant: TDK CORPORATION, Tokyo (JP)

(72) Inventors: Hanako Yoshino, Tokyo (JP); Hiroshi Suzuki, Tokyo (JP); Daisuke Urabe, Tokyo (JP); Keigo Higashida, Tsuruoka (JP); Tomokazu Tsuchiya, Tokyo (JP)

(73) Assignee: TDK CORPORATION, Tokyo (JP)

( * ) Notice: Subject to any disclaimer, the term of this patent is extended or adjusted under 35 U.S.C. 154(b) by 545 days.

(21) Appl. No.: 16/751,725

(22) Filed: Jan. 24, 2020

(65) Prior Publication Data

US 2020/0243251 A1 Jul. 30, 2020

(30) Foreign Application Priority Data

Jan. 28, 2019 (JP) ..... JP2019-012475

(51) Int. Cl.

| | |
|---|---|
| ***H01F 27/28*** | (2006.01) |
| ***H01F 41/069*** | (2016.01) |
| ***H01F 27/24*** | (2006.01) |
| ***H01F 27/29*** | (2006.01) |

(52) U.S. Cl.

CPC ..... *H01F 27/2823* (2013.01); *H01F 27/24* (2013.01); *H01F 27/29* (2013.01); *H01F 41/069* (2016.01); *Y10T 29/5313* (2015.01)

(58) Field of Classification Search

CPC ..... H01F 17/045; H01F 27/306; H01F 41/06; H01F 41/069; H01F 27/30; H01F 27/2823; Y10T 29/49073; Y10T 29/5312; Y10T 29/5313

USPC ..... 29/729, 602.1, 604, 606, 737, 740, 787, 29/795

See application file for complete search history.

(56) References Cited

U.S. PATENT DOCUMENTS 5,305,961 A * 4/1994 Errard ..... H01F 27/2823 29/605
9,431,165 B2 * 8/2016 Ukai ..... H01F 17/045

FOREIGN PATENT DOCUMENTS

JP H1174133 A * 8/1997
JP H11-074133 A 3/1999

* cited by examiner

*Primary Examiner* — Thiem D Phan
(74) *Attorney, Agent, or Firm* — Young Law Firm, P.C.

(57) ABSTRACT

Disclosed herein is a coil component that includes a winding core part, and first and second wires wound around the winding core part. The first and second wires constitute at least three winding layers on the winding core part. A i-th (i is an integer equal to or larger than 1) turn, a (i+1) turn, and a (i+2) turn of each of the first and second wires are positioned in mutually different winding layers.

10 Claims, 17 Drawing Sheets

COIL COMPONENT

BACKGROUND OF THE INVENTION

Field of the Invention

The present invention relates to a coil component and, more particularly, to a coil component in which a wire is wound around a winding core part thereof in multiple layers.

Description of Related Art

To increase the inductance of a coil component in which a wire is wound around a winding core part thereof, it is necessary to increase the number of turns of the wire. However, when the wire is wound around a winding core part in a single layer, the length necessary for the winding core part is increased in proportion to the number of turns. Thus, in order to increase the number of turns of the wire while suppressing an increase in the length of the winding core part, the wire needs to be wound around the winding core part in multiple layers as described in JP 1999-74133A.

Meanwhile, the coil component mainly used in a power supply circuit is required to provide low DC resistance and high rated current. In order to satisfy the requirements, it is conceivable to use a method of using two wires connected in parallel. For instance, JP 1999-74133A discloses, in FIGS. 6 to 8, a coil component using two wires wound in multiple layers.

However, in the winding structure disclosed in JP 1999-74133A (FIGS. 6 to 8), turns between which a difference in turn number is large are adjacent to each other, so that a large parasitic capacitance component is disadvantageously generated. That is, a parasitic capacitance component generated by two turns between which a difference in turn number is small is mainly connected in series and is thus reduced in value, while a parasitic capacitance component generated by two turns between which a difference in turn number is large is mainly connected in parallel and thus tends to increase in value.

SUMMARY

It is therefore an object of the present invention to reduce a parasitic capacitance component in a coil component in which two wires are wound in multiple layers.

A coil component according to the present invention includes a winding core part and first and second wires wound around the winding core part. The first and second wires constitute at least three winding layers on the winding core part, and the i-th (i is an integer equal to or larger than 1) turn, (i+1) turn and (i+2) turn of each of the first and second wires are positioned in mutually different winding layers.

According to the present invention, the i-th to (i-th+2) turns between which a difference in turn number is small are disposed in mutually different winding layers, so that it is possible to prevent an increase of parasitic capacitance component due to proximity between two turns between which a difference in turn number is large.

In the present invention, the first and second wires may constitute three winding layers including, in order of proximity from the winding core part, a lower layer, an intermediate layer and an upper layer. The i-th turn of each of the first and second wires may be wound in the lower layer, (i-th+1) turn of each of the first and second wires may be wound in the intermediate layer, and (i-th+2) turn of each of the first and second wires may be wound in the upper layer. Thus, by repeatedly forming a winding pattern including the i-th to (i-th+2) turns of each of the first and second wires, a regular winding structure including the three winding layers can be obtained.

In the present invention, (i-th+4) turn of the first wire may be wound along a valley line formed by the i-th turn of the first wire and the i-th turn of the second wire, and (i-th+5) turn of the first wire may be wound along a valley line formed by (i-th+1) turn of the first wire and (i-th+1) turn of the second wire. With this configuration, (i-th+4) turn of the first wire can be supported by the valley line formed by the i-th turn of the first wire and the i-th turn of the second wire, and (i-th+5) turn of the first wire can be supported by a valley line formed by (i-th+1) turn of the first wire and (i-th+1) turn of the second wire.

In this case, (i-th+4) turn of the second wire may be wound along a valley line formed by (i-th+3) turn of the first wire and i-th turn of the second wire, and (i-th+5) turn of the second wire may be wound along a valley line formed by (i-th+4) turn of the first wire and (i-th+1) turn of the second wire. With this configuration, (i-th+4) turn of the second wire can be supported by the valley line formed by (i-th+3) turn of the first wire and i-th turn of the second wire, and (i-th+5) turn of the second wire can be supported by the valley line formed by (i-th+4) turn of the first wire and (i-th+1) turn of the second wire.

In the present invention, (i-th+7) turn of the first wire may be wound along a valley line formed by the i-th turn of the first wire and the i-th turn of the second wire, and (i-th+5) turn of the first wire may be wound along a valley line formed by (i-th+1) turn of the first wire and (i-th+1) turn of the second wire. With this configuration, (i-th+7) turn of the first wire can be supported by the valley line formed by the i-th turn of the first wire and the i-th turn of the second wire, and (i-th+5) turn of the first wire can be supported by the valley line formed by (i-th+1) turn of the first wire and (i-th+1) turn of the second wire.

In this case, (i-th+7) turn of the second wire may be wound along a valley line formed by (i-th+3) turn of the first wire and i-th turn of the second wire, and (i-th+5) turn of the second wire may be wound along a valley line formed by (i-th+4) turn of the first wire and (i-th+1) turn of the second wire. With this configuration, (i-th+7) turn of the second wire can be supported by the valley line formed by (i-th+3) turn of the first wire and i-th turn of the second wire, and (i-th+5) turn of the second wire can be supported by the valley line formed by (i-th+4) turn of the first wire and (i-th+1) turn of the second wire.

In the present invention, the first and second wires may constitute four winding layers including, in order of proximity from the winding core part, a lower layer, a first intermediate layer, a second intermediate layer and an upper layer. The i-th turn of each of the first and second wires may be wound in the lower layer, (i-th+1) turn of each of the first and second wires may be wound in the first intermediate layer, (i-th+2) turn of each of the first and second wires may be wound in the second intermediate layer, and (i-th+3) turn of each of the first and second wires may be wound in the upper layer. Thus, by repeatedly forming a winding pattern including the i-th to (i-th+3) turns of each of the first and second wires, a regular winding structure including the four winding layers can be obtained.

In the present invention, (i-th+5) turn of the first wire may be wound along a valley line formed by the i-th turn of the first wire and the i-th turn of the second wire, (i-th+6) turn of the first wire may be wound along a valley line formed by (i-th+1) turn of the first wire and (i-th+1) turn of the second wire, and (i-th+7) turn of the first wire may be wound along a valley line formed by (i-th+2) turn of the first wire and (i-th+2) turn of the second wire. With this configuration, (i-th+5) turn of the first wire can be supported by the valley line formed by the i-th turn of the first wire and the i-th turn of the second wire, (i-th+6) turn of the first wire can be supported by the valley line formed by (i-th+1) turn of the first wire and (i-th+1) turn of the second wire, and (i-th+7) turn of the first wire can be supported by the valley line formed by (i-th+2) turn of the first wire and (i-th+2) turn of the second wire.

In this case, (i-th+5) turn of the second wire may be wound along a valley line formed by (i-th+4) turn of the first wire and the i-th turn of the second wire, (i-th+6) turn of the second wire may be wound along a valley line formed by (i-th+5) turn of the first wire and (i-th+1) turn of the second wire, and (i-th+7) turn of the second wire may be wound along a valley line formed by (i-th+6) turn of the first wire and (i-th+2) turn of the second wire. With this configuration, (i-th+5) turn of the second wire can be supported by the valley line formed by (i-th+4) turn of the first wire and the i-th turn of the second wire, (i-th+6) turn of the second wire can be supported by the valley line formed by (i-th+5) turn of the first wire and (i-th+1) turn of the second wire, and (i-th+7) turn of the second wire can be supported by the valley line formed by (i-th+6) turn of the first wire and (i-th+2) turn of the second wire.

In the present invention, (i-th+9) turn of the first wire may be wound along a valley line formed by the i-th turn of the first wire and the i-th turn of the second wire, (i-th+6) turn of the first wire may be wound along a valley line formed by (i-th+1) turn of the first wire and (i-th+1) turn of the second wire, and (i-th+7) turn of the first wire may be wound along a valley line formed by (i-th+2) turn of the first wire and (i-th+2) turn of the second wire. With this configuration, (i-th+9) turn of the first wire can be supported by the valley line formed by the i-th turn of the first wire and the i-th turn of the second wire, (i-th+6) turn of the first wire can be supported by the valley line formed by (i-th+1) turn of the first wire and (i-th+1) turn of the second wire, and (i-th+7) turn of the first wire can be supported by the valley line formed by (i-th+2) turn of the first wire and (i-th+2) turn of the second wire.

In this case, (i-th+9) turn of the second wire may be wound along a valley line formed by (i-th+4) turn of the first wire and the i-th turn of the second wire, (i-th+6) turn of the second wire may be wound along a valley line formed by (i-th+5) turn of the first wire and (i-th+1) turn of the second wire, and (i-th+7) turn of the second wire may be wound along a valley line formed by (i-th+6) turn of the first wire and (i-th+2) turn of the second wire. With this configuration, (i-th+9) turn of the second wire can be supported by the valley line formed by (i-th+4) turn of the first wire and the i-th turn of the second wire, (i-th+6) turn of the second wire can be supported by the valley line formed by (i-th+5) turn of the first wire and (i-th+1) turn of the second wire, and (i-th+7) turn of the second wire can be supported by the valley line formed by (i-th+6) turn of the first wire and (i-th+2) turn of the second wire.

The coil component according to the present invention may further include a flange part and a terminal electrode provided on the flange part and connected with one ends of the first and second wires, and the one ends of the first and second wires may be short-circuited through the terminal electrode. With this configuration, the first and second wires can be connected in parallel.

As described above, according to the coil component of the present invention, it is possible to prevent an increase of parasitic capacitance component due to proximity between two turns between which a difference in turn number is large.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
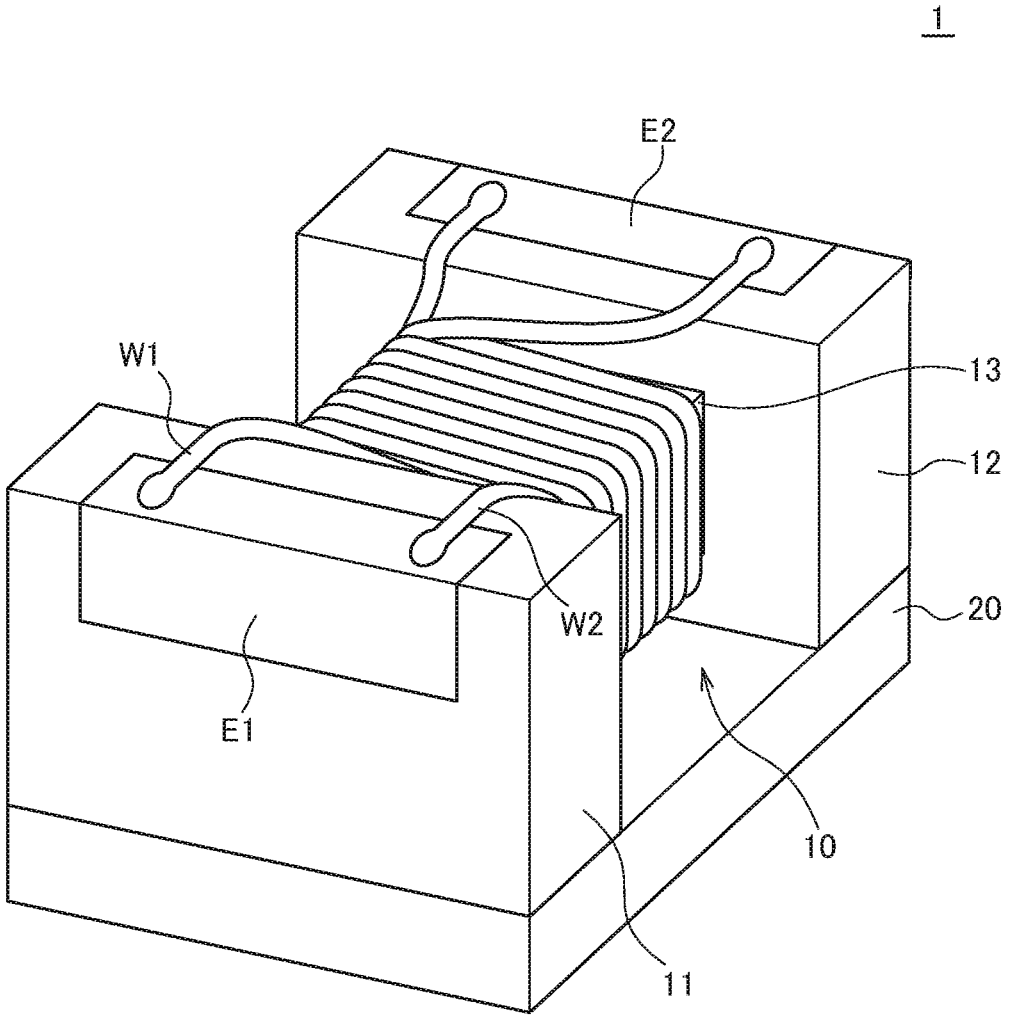
FIG. 1 is a schematic perspective view illustrating the outer appearance of a coil component according to a preferred embodiment of the present invention.

FIG. 1 is a schematic perspective view illustrating the outer appearance of a coil component 1 according to a preferred embodiment of the present invention.

As illustrated in FIG. 1, the coil component 1 according to the present embodiment includes a drum-shaped core 10 having flange parts 11 and 12 and a winding core part 13, a plate-shaped core 20 fixed to the flange parts 11 and 12, a terminal electrode E1 provided on the flange part 11, a terminal electrode E2 provided on the flange part 12, and wires W1 and W2 wound around the winding core part 13. The wires W1 and W2 are each a coated conductive wire with a good conductor such as copper as a core material.

The core 10 is a drum-shaped block made of a high-permeability material such as ferrite and has a structure integrating the flange parts 11, 12 and the winding core part 13 provided therebetween. The core 20 is a plate-shaped block also made of a high-permeability material such as ferrite. The cores 10 and 20 are fixed to each other by an adhesive. One ends of the wires W1 and W2 are connected to the terminal electrode E1, and the other ends thereof are connected to the terminal electrode E2. The terminal electrodes E1 and E2 are each formed of silver paste fired on the core 10. Thus, the one ends of the wires W1 and W2 are short-circuited through the terminal electrode E1, and the other ends thereof are short-circuited through the terminal electrode E2. That is, the wires W1 and W2 are connected in parallel between the terminal electrodes E1 and E2. The reason that the wires W1 and W2 are connected in parallel is that the coil component 1 according to the present embodiment is a coil component for a power supply circuit and required to have a low DC resistance and a high rated current.

In place of the terminal electrodes E1 and E2, a terminal fitting may be used. For example, as in a coil component 2 according to a modification illustrated in FIG. 2, a terminal fitting 30 fixed to the flange part 11 and a terminal fitting 40 fixed to the flange part 12 may be used. The terminal fitting 30 is a terminal electrode fixed to the flange part 11 of the core 10 by an adhesive or the like and is connected with one ends of the wires W1 and W2, and the terminal fitting 40 is a terminal electrode fixed to the flange part 12 of the core 10 by an adhesive or the like and is connected with the other ends of the wires W1 and W2.

Figure 2:
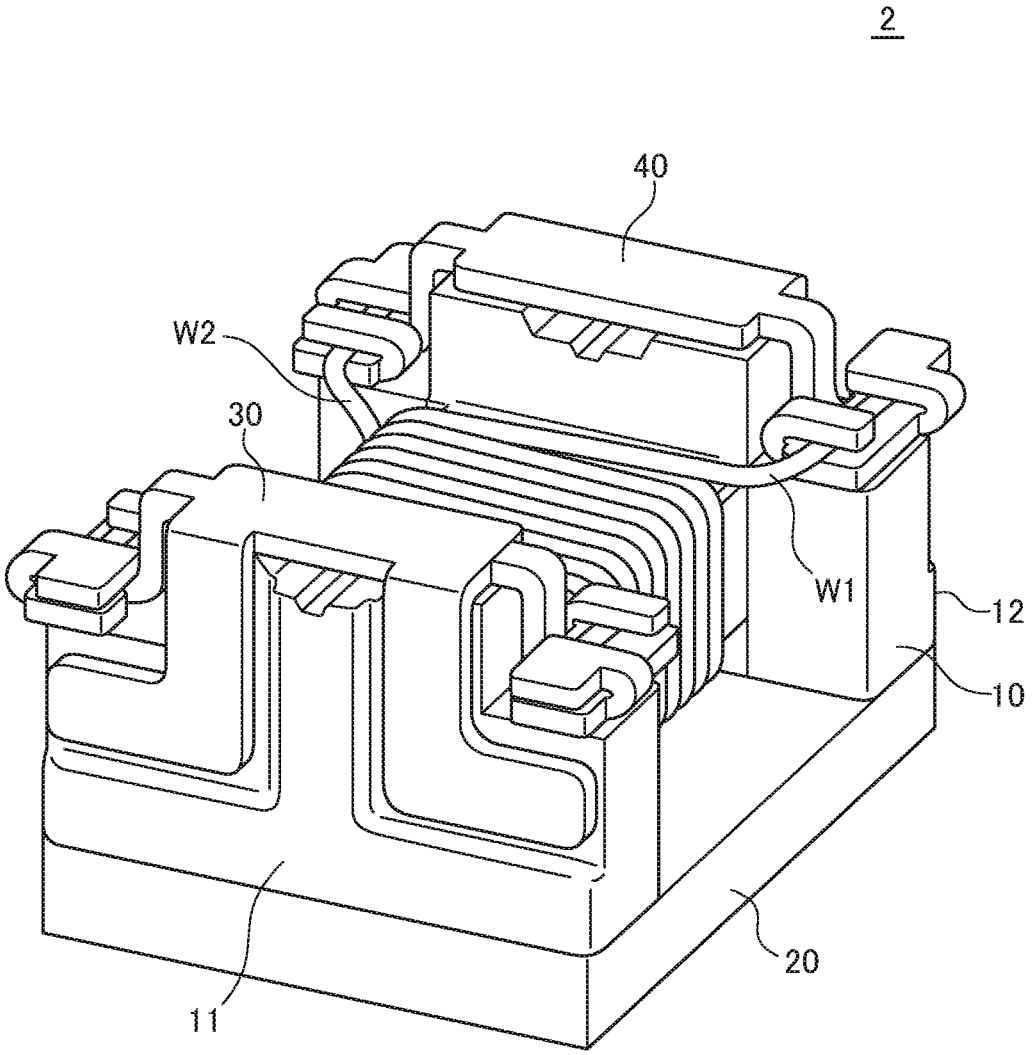
FIG. 2 is a schematic perspective view illustrating the outer appearance of a coil component according to a first modification.
Figure 3:
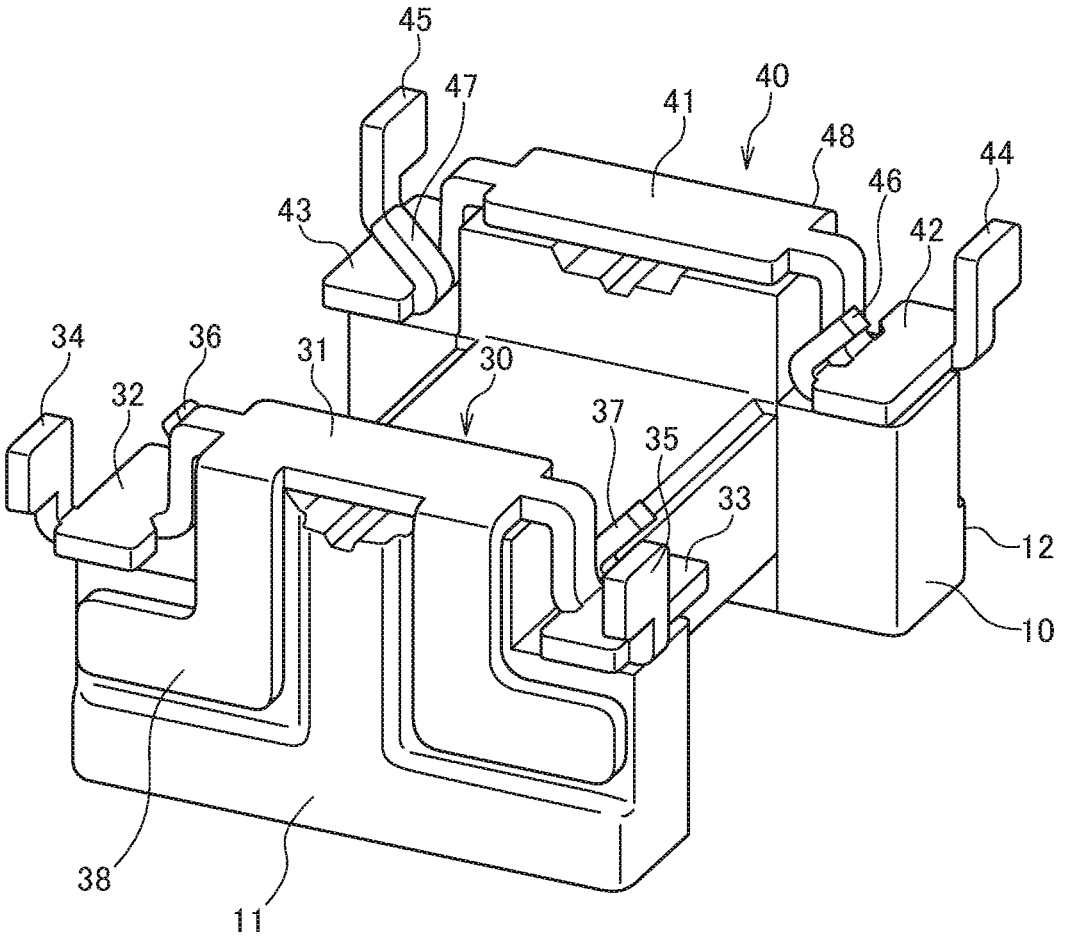
FIG. 3 is a schematic perspective view illustrating a state before the wire is wound around the winding core part.

At the time of manufacturing the coil component 2, the terminal fittings 30 and 40 are bonded to the core 10, and then one ends of the wires W1 and W2 are connected to the terminal fitting 30. As illustrated in FIG. 3, the terminal fitting 30 in a state before wire connection has a mounting part 31, first and second wire connection parts 32 and 33, first and second welding tabs 34 and 35, first and second fixing tabs 36 and 37, and a fillet formation part 38. In a state where the one end of the wire W1 is disposed on the wire connection part 32, the fixing tab 36 is folded to thereby secure the one end of the wire W1 to the wire connection part 32, and in a state where the one end of the wire W2 is disposed on the wire connection part 33, the fixing tab 37 is folded to thereby secure the one end of the wire W2 to the wire connection part 33. In this state, the welding tabs 34 and 35 are folded and melted by heat, whereby the terminal fitting 30 and the one ends of the wires W1 and W2 are welded. Thereafter, the core 10 is rotated to wind the wires W1 and W2 around the winding core part 13. Similarly, the terminal fitting 40 in a state before wire connection has a mounting part 41, first and second wire connection parts 42 and 43, first and second welding tabs 44 and 45, first and second fixing tabs 46 and 47, and a fillet formation part 48. In a state where the other end of the wire W1 is disposed on the wire connection part 42, the fixing tab 46 is folded to thereby secure the other end of the wire W1 to the wire connection part 42, and in a state where the other end of the wire W2 is disposed on the wire connection part 43, the fixing tab 47 is folded to thereby secure the other end of the wire W2 to the wire connection part 43. In this state, the welding tabs 44 and 45 are folded and melted by heat, whereby the terminal fitting 40 and the other ends of the wires W1 and W2 are welded. Finally, the core 20 is bonded to the core 10, whereby the coil component 2 illustrated in FIG. 2 is completed.

In the coil component 2 in actual use, the land pattern on the printed circuit board and the mounting parts 31 and 41 of the terminal fittings 30 and 40 are connected through a solder. At this time, the solder reaches the fillet formation parts 38 and 48 by surface tension to form a solder fillet.

Figure 4:
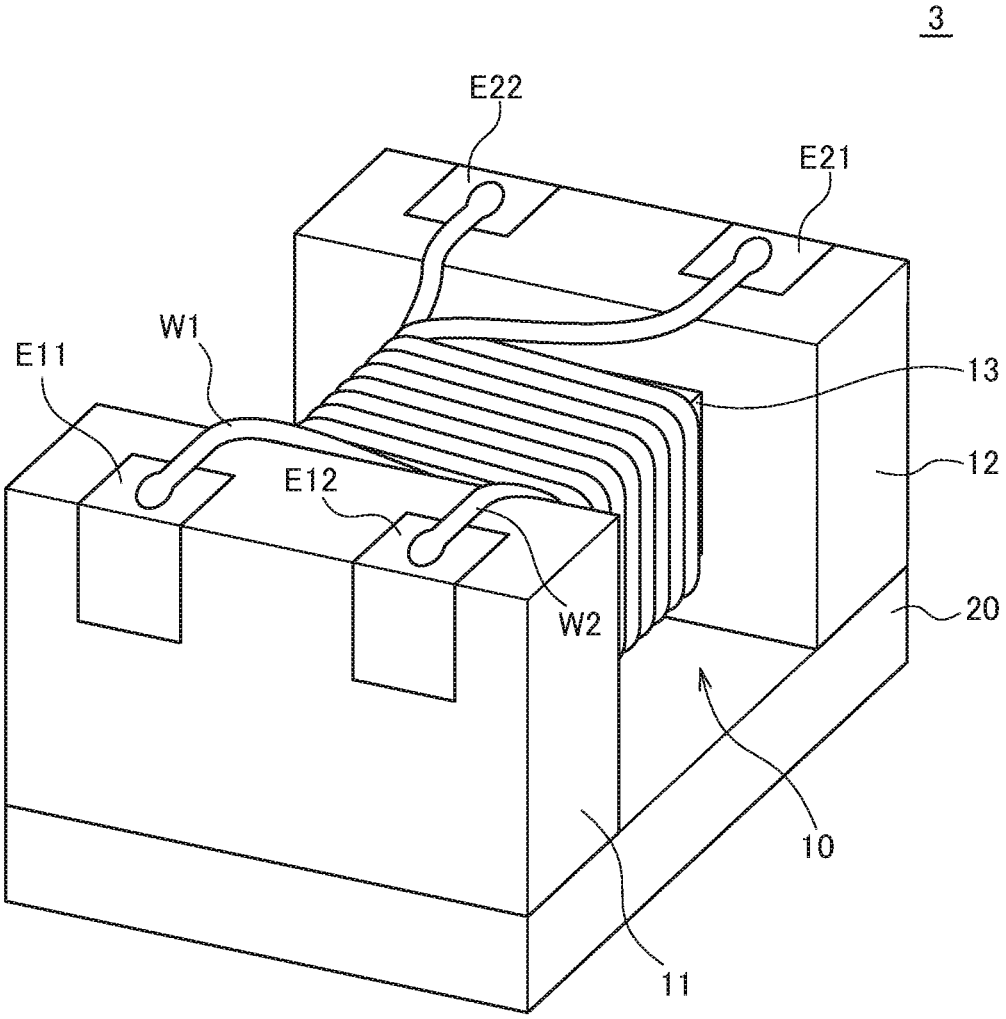
FIG. 4 is a schematic perspective view illustrating the outer appearance of a coil component according to a second modification.
Figure 5:
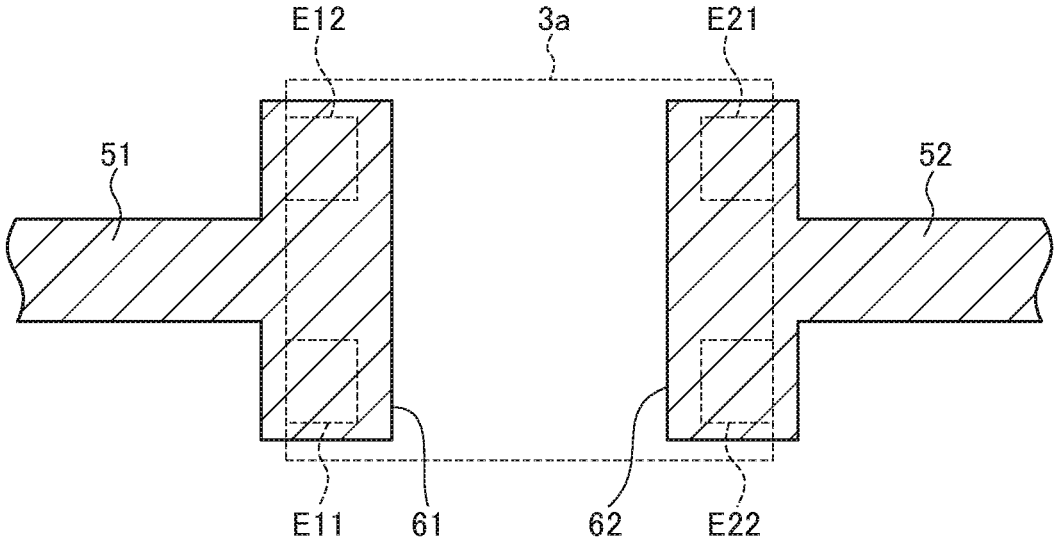
FIG. 5 is a schematic plan view illustrating the pattern shape of a printed circuit board on which the coil component is mounted.

In the present embodiment, it is not essential to short-circuit the one ends of the wires W1 and W2 on the flange part 11 and to short-circuit the other ends thereof on the flange parts 12 but a configuration as in a coil component 3 according to a second modification illustrated in FIG. 4 may be adopted, in which two terminal electrodes E11 and E12 are provided on the flange part 11, two terminal electrodes E21 and E22 are provided on the flange part 12, one ends of the wire W1 and W2 are connected to the terminal electrodes E11 and E12, respectively, and the other ends of the wire W1 and W2 are connected to the terminal electrodes E21 and E22, respectively. In this case, by short-circuiting the terminal electrodes E11 and E12 and short-circuiting the terminal electrodes E21 and E22 on a printed circuit board on which the coil component 3 is mounted, the wires W1 and W2 can be connected in parallel. For example, as illustrated in FIG. 5, the coil component 3 may be mounted on a mounting area 3*a* of a printed circuit board having a land pattern 61 connected to a wire 51 and a land pattern 62 connected to a wire 52. When the coil component 3 is mounted on the mounting area 3*a*, the terminal electrodes E11 and E12 are connected in common to the land pattern 61, and the terminal electrodes E21 and E22 are connected in common to the land pattern 62, with the result that the wires W1 and W2 are connected in parallel.

In the present embodiment, the two wires W1 and W2 are wound around the winding core part 13 of the core 10 in multiple turns and in multiple layers.

The following describes in detail the winding structure of the wires W1 and W2.

Figure 6:
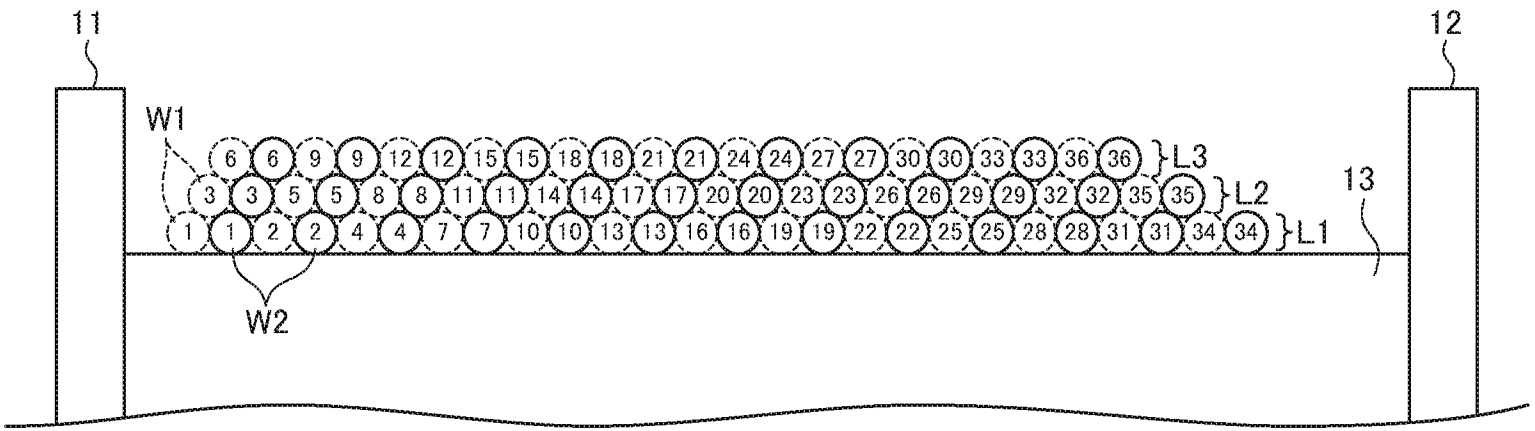
FIG. 6 is a schematic cross-sectional view for explaining a first winding structure of the wires.

FIG. 6 is a schematic cross-sectional view for explaining a first winding structure of the wires W1 and W2.

The number assigned to each of the wires W1 and W2 in FIG. 6 indicates the number of turns with the terminal electrode E1 (E11, E12) or metal fitting 30 as a winding starting point. The same applies to FIGS. 7 to 16. In the examples described below, the number of turns of the wire W1 and the number of turns of the wire W2 are each set to 36, but not limited thereto.

In the first winding structure illustrated in FIG. 6, the wires W1 and W2 constitute three winding layers on the winding core part 13. The three winding layers include a lower layer L1 closest to the winding core part 13, an upper layer L3 farthest from the winding core part 13, and an intermediate layer L2 positioned between the lower layer L1 and the upper layer L3. In the example of FIG. 6, the lower layer L1 constitutes the lowermost layer, and the upper layer L3 constitutes the uppermost layer.

As illustrated in FIG. 6, 1st, 2nd, 4th, 7th, 10th, 13th, 16th, 19th, 22nd, 25th, 28th, 31st and 34th turns of each of the wires W1 and W2 are wound in the lower layer L1, 3rd, 5th, 8th, 11th, 14th, 17th, 20th, 23rd, 26th, 29th, 32nd and 35th turns of each of the wires W1 and W2 are wound in the intermediate layer L2, and the 6th, 9th, 12th, 15th, 18th, 21st, 24th, 27th, 30th, 33rd and 36th turns of each of the wires W1 and W2 are wound in the upper layer L3. In this winding structure, turns of the respective wires W1 and W2 constituting a pair (turns having the same number) are adjacently disposed in mutually the same winding layer.

The turns wound in the intermediate layer L2 are each wound along a valley line formed by two adjacent turns wound in the lower layer L1. Similarly, the turns wound in the upper layer L3 are each wound along a valley line formed by two adjacent turns wound in the intermediate layer L2. Specifically, the 8th, 11th, 14th, 17th, 20th, 23rd, 26th, 29th, 32nd and 35 turns of the wire W1 wound in the intermediate layer L2 are each wound along a valley line formed by a turn of the wire W1 wound in the lower layer L1 whose turn number is smaller by 4 therethan and a turn of the wire W2 wound in the lower layer L1 whose turn number is smaller by 4 therethan, and the 8th, 11th, 14th, 17th, 20th, 23rd, 26th, 29th, 32nd and 35th turns of the wire W2 wound in the intermediate layer L2 are each wound along a valley line formed by a turn of the wire W1 wound in the lower layer L1 whose turn number is smaller by 1 therethan and a turn of the wire W2 wound in the lower layer L1 whose turn number is smaller by 4 therethan. Further, the 9th, 12th, 15th, 18th, 21st, 24th, 27th, 30th, 33rd and 36th turns of the wire W1 wound in the upper layer L3 are each wound along a valley line formed by a turn of the wire W1 wound in the intermediate layer L2 whose turn number is smaller by 4 therethan and a turn of the wire W2 wound in the intermediate layer L2 whose turn number is smaller by 4 therethan, and the 9th, 12th, 15th, 18th, 21st, 24th, 27th, 30th, 33rd and 36th turns of the wire W2 wound in the upper layer L3 are each wound along a valley line formed by a turn of the wire W1 wound in the intermediate layer L2 whose turn number is smaller by 1 therethan and a turn of the wire W2 wound in the intermediate layer L2 whose turn number is smaller by 4 therethan.

More generally, the i-th turn (i is an integer equal to or larger than 1) of each of the wires W1 and W2 is wound in the lower layer L1, (i-th+1) turn of each of the wires W1 and W2 is wound in the intermediate layer L2, and (i-th+2) turn of each of the wires W1 and W2 is wound in the upper layer L3. Further, (i-th+4) turn of the wire W1 is wound along a valley line formed by the i-th turn of the wire W1 and the i-th turn of the wire W2, and (i-th+4) turn of the wire W2 is wound along a valley line formed by (i-th+3) turn of the wire W1 and i-th turn of the wire W2. Furthermore, (i-th+5) turn of the wire W1 is wound along a valley line formed by (i-th+1) turn of the wire W1 and (i-th+1) turn of the wire W2, and (i-th+5) turn of the wire W2 is wound along a valley line formed by (i-th+4) turn of the wire W1 and (i-th+1) turn of the wire W2.

Figure 7:
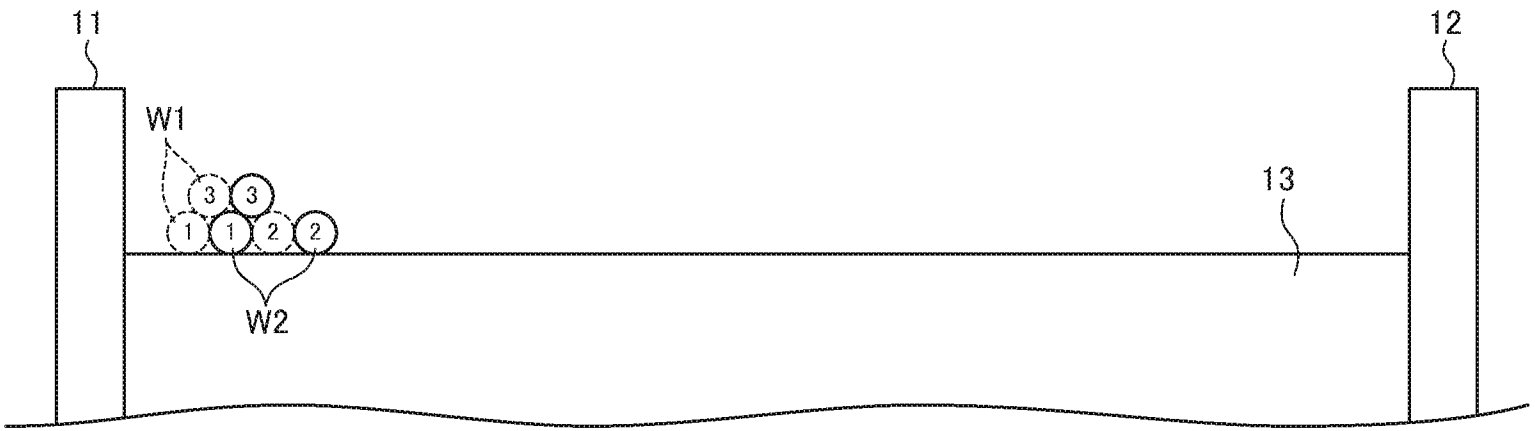
FIGS. 7 and 8 are schematic process diagrams for explaining a method for obtaining the first winding structure.

A method for obtaining the first winding structure illustrated in FIG. 6 is as follows. As illustrated in FIG. 7, first, the 1st turns of the respective wires W1 and W2 and the 2nd turns thereof are wound side by side in the lower layer L1. Then, the 3rd turn of the wire W1 is wound along a valley line formed by the 1st turns of the respective wires W1 and W2, and the 3rd turn of the wire W2 is wound along a valley line formed by the 1st turn of the wire W2 and the 2nd turn of the wire W1. The above-described 1st to 3rd turns of the wire W1 and those of the wire W2 collectively constitute a wall for properly winding the 4th and subsequent turns of each of the wires W1 and W2 so as to prevent collapse of the winding.

Figure 8:
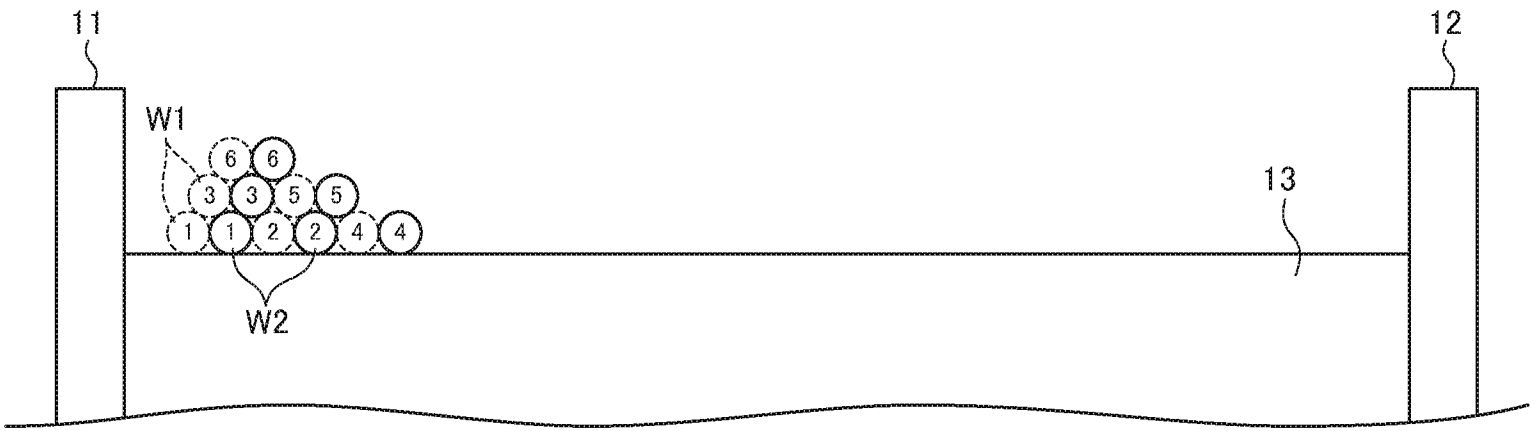

Then, as illustrated in FIG. 8, the 4th turns of the respective wires W1 and W2 are wound side by side with the 2nd turns thereof in the lower layer L1. Subsequently, the 5th turn of the wire W1 is wound along a valley line formed by the 2nd turns of the respective wires W1 and W2, and the 5th turn of the wire W2 is wound along a valley line formed by the 2nd turn of the wire W2 and the 4th turn of the wire W1. Further, the 6th turn of the wire W1 is wound along a valley line formed by the 3rd turns of the respective wires W1 and W2, and the 6th turn of the wire W2 is wound along a valley line formed by the 3rd turn of the wire W2 and the 5th turn of the wire W1.

After that, the winding work is repeatedly performed under the same rule as for the winding work of the three turns including the above-described 4th to 6th turns. That is, by repeatedly forming a winding pattern including the i-th to (i-th+2) turns, the first winding structure having a regular winding structure can be obtained.

As described above, in the first winding structure, the same turns of the wires W1 and W2 are disposed in the same layer, and three consecutive turns of each of the wires W1 and W2 are disposed in mutually different layers. Thus, it is possible to prevent a situation where two turns between which a difference in turn number is large are adjacent to each other, which occurs when a plurality of consecutive turns of each of the wires W1 and W2 are sequentially wound, to thereby prevent an increase of parasitic capacitance component. That is, a parasitic capacitance component generated by two turns between which a difference in turn number is small is mainly connected in series and is thus reduced in value, while a parasitic capacitance component generated by two turns between which a difference in turn number is large is mainly connected in parallel and thus tends to increase in value. In the first winding structure, a difference in turn number between adjacent turns is suppressed to 4 at maximum, so that an increase of parasitic capacitance component is suppressed, thus allowing an increase in resonance frequency.

Figure 9:
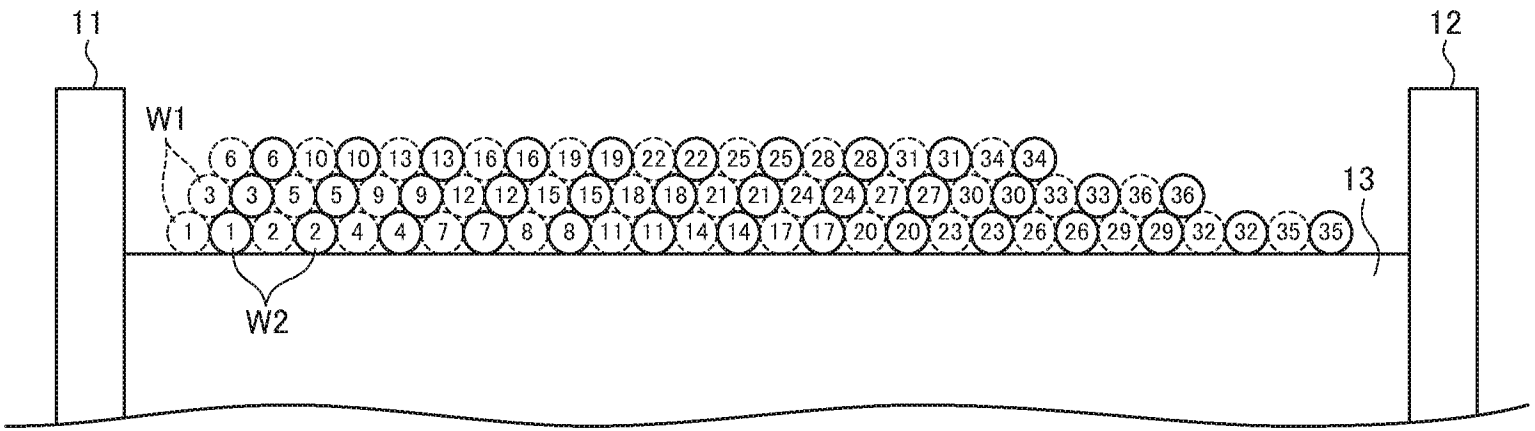
FIG. 9 is a schematic cross-sectional view for explaining a second winding structure of the wires.

FIG. 9 is a schematic cross-sectional view for explaining a second winding structure of the wires W1 and W2.

In the second winding structure illustrated in FIG. 9, the wires W1 and W2 constitute three winding layers on the winding core part 13.

As illustrated in FIG. 9, 1st, 2nd, 4th, 7th, 8th, 11th, 14th, 17th, 20th, 23rd, 26th, 29th, 32nd and 35th turns of each of the wires W1 and W2 are wound in the lower layer L1, the 3rd, 5th, 9th, 12th, 15th, 18th, 21st, 24th, 27th, 30th, 33rd and 36th turns of each of the wires W1 and W2 are wound in the intermediate layer L2, and the 6th, 10th, 13th, 16th, 19th, 22nd, 25th, 28th, 31st and 34th turns of each of the wires W1 and W2 are wound in the upper layer L3. In this winding structure, turns of the respective wires W1 and W2 constituting a pair (turns having the same number) are adjacently disposed in mutually the same winding layer.

The turns wound in the intermediate layer L2 are each wound along a valley line formed by two adjacent turns wound in the lower layer L1. Similarly, the turns wound in the upper layer L3 are each wound along a valley line formed by two adjacent turns wound in the intermediate layer L2. Specifically, the 15th, 18th, 21st, 24th, 27th, 30th, 33rd and 36th turns of the wire W1 wound in the intermediate layer L2 are each wound along a valley line formed by a turn of the wire W1 wound in the lower layer L1 whose turn number is smaller by 7 therethan and a turn of the wire W2 wound in the lower layer L1 whose turn number is smaller by 7 therethan, and the 15th, 18th, 21st, 24th, 27th, 30th, 33rd and 36th turns of the wire W2 wound in the intermediate layer L2 are each wound along a valley line formed by a turn of the wire W1 wound in the lower layer L1 whose turn number is smaller by 4 therethan and a turn of the wire W2 wound in the lower layer L1 whose turn number is smaller by 7 therethan. Further, the 13th, 16th, 19th, 22nd, 25th, 28th, 31st and 34th turns of the wire W1 wound in the upper layer L3 are each wound along a valley line formed by a turn of the wire W1 wound in the intermediate layer L2 whose turn number is smaller by 4 therethan and a turn of the wire W2 wound in the intermediate layer L2 whose turn number is smaller by 4 therethan, and the 13th, 16th, 19th, 22nd, 25th, 28th, 31st and 34th turns of the wire W2 wound in the upper layer L3 are each wound along a valley line formed by a turn of the wire W1 wound in the intermediate layer L2 whose turn number is smaller by 1 therethan and a turn of the wire W2 wound in the intermediate layer L2 whose turn number is smaller by 4 therethan.

More generally, the i-th turn (i is an integer equal to or larger than 1) of each of the wires W1 and W2 is wound in the lower layer L1, (i-th+1) turn of each of the wires W1 and W2 is wound in the intermediate layer L2, and (i-th+2) turn of each of the wires W1 and W2 is wound in the upper layer L3. Further, (i-th+7) turn of the wire W1 is wound along a valley line formed by the i-th turn of the wire W1 and the i-th turn of the wire W2, and (i-th+7) turn of the wire W2 is wound along a valley line formed by (i-th+3) turn of the wire W1 and i-th turn of the wire W2. Furthermore, (i-th+5) turn of the wire W1 is wound along a valley line formed by (i-th+1) turn of the wire W1 and (i-th+1) turn of the wire W2, and (i-th+5) turn of the wire W2 is wound along a valley line formed by (i-th+4) turn of the wire W1 and (i-th+1) turn of the wire W2.

Figure 10:
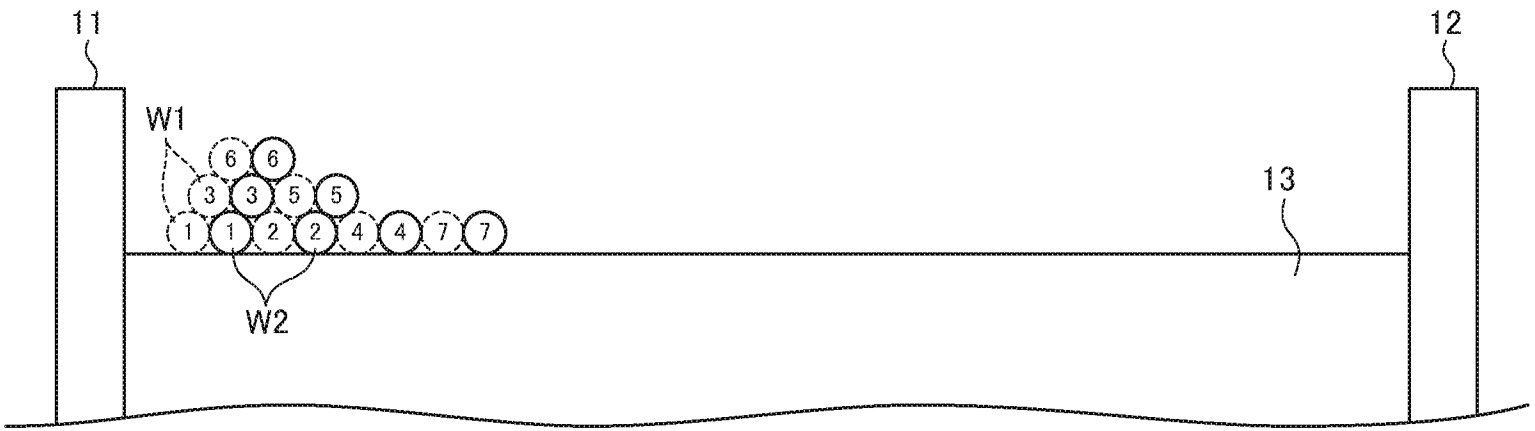
FIGS. 10 to 12 are schematic process diagrams for explaining a method for obtaining the second winding structure.

A method for obtaining the second winding structure illustrated in FIG. 9 is as follows. As illustrated in FIG. 10, first, the 1st turns of the respective wires W1 and W2 and the 2nd turns thereof are wound side by side in the lower layer L1. Then, the 3rd turn of the wire W1 is wound along a valley line formed by the 1st turns of the respective wires W1 and W2, and the 3rd turn of the wire W2 is wound along a valley line formed by the 1st turn of the wire W2 and the 2nd turn of the wire W1. Subsequently, the 4th turns of the respective wires W1 and W2 are wound side by side with the 2nd turns thereof in the lower layer L1. Subsequently, the 5th turn of the wire W1 is wound along a valley line formed by the 2nd turns of the respective wires W1 and W2, and the 5th turn of the wire W2 is wound along a valley line formed by the 1st turn of the wire W2 and the 4th turn of the wire W1. Subsequently, the 6th turn of the wire W1 is wound along a valley line formed by the 3rd turns of the respective wires W1 and W2, and the 6th turn of the wire W2 is wound along a valley line formed by the 3rd turn of the wire W2 and the 5th turn of the wire W1. Further, the 7th turns of the respective wires W1 and W2 are wound side by side with the 4th turns thereof in the lower layer L1. The above-described 1st to 7th turns of the wire W1 and those of the wire W2 collectively constitute a wall for properly winding the 8th and subsequent turns of each of the wires W1 and W2 so as to prevent collapse of the winding. In the second winding structure, in the turns constituting the wall, the number of turns wound in the lower layer L1 is larger by 4 than the number of turns wound in the intermediate layer L2, so that collapse of the winding is less likely to occur in the subsequent winding work.

Figure 11:
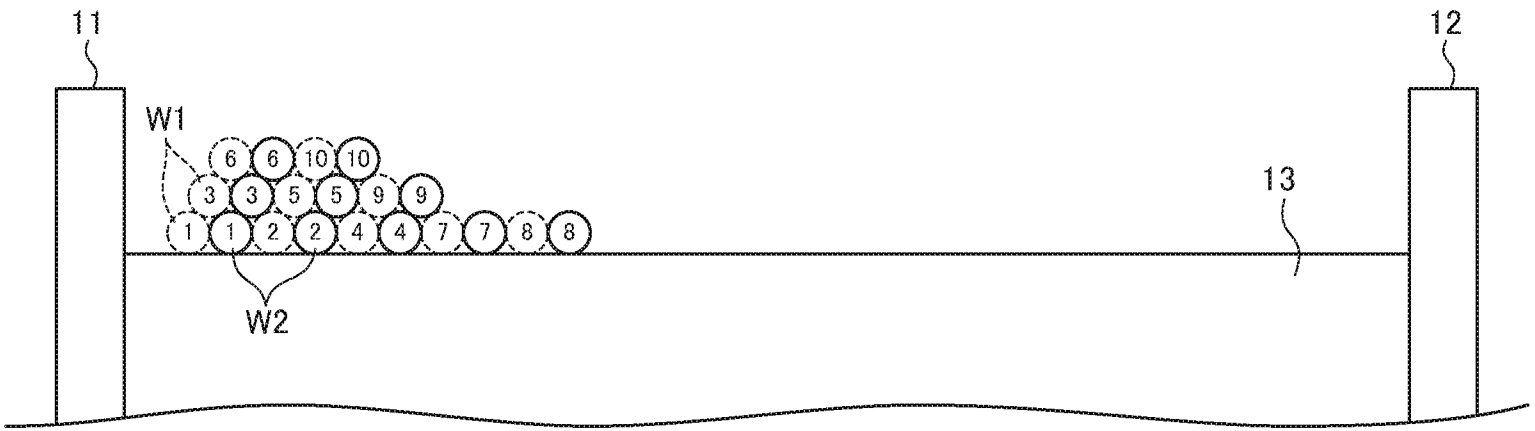
Figure 12:
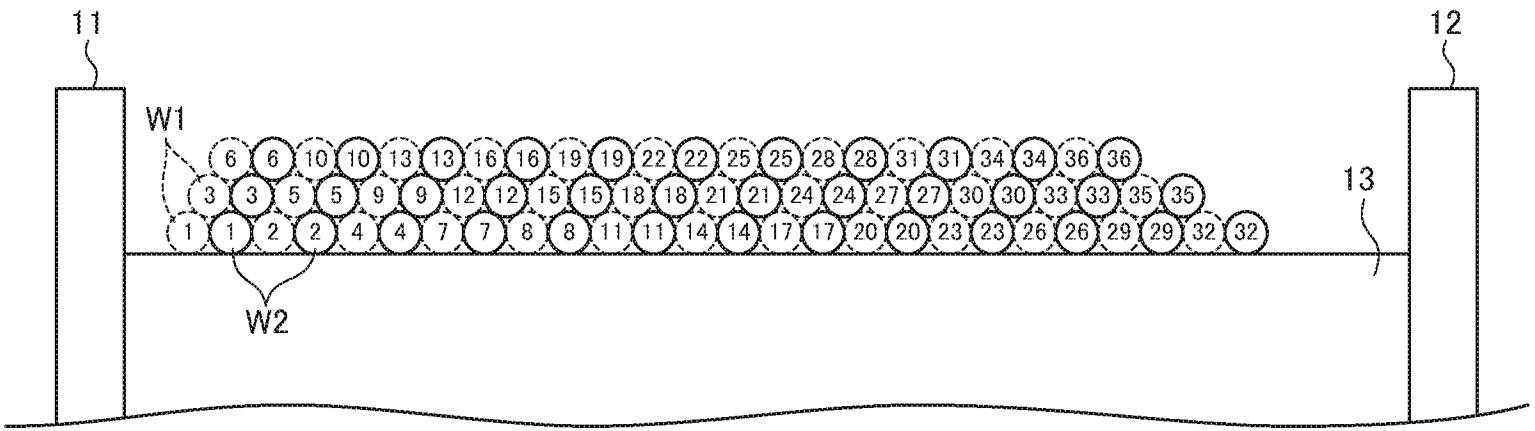

Subsequently, as illustrated in FIG. 11, the 8th turns of the respective wires W1 and W2 are wound side by side with the 7th turns thereof in the lower layer L1. Subsequently, the 9th turn of the wire W1 is wound along a valley line formed by the 4th turns of the respective wires W1 and W2, and the 9th turn of the wire W2 is wound along a valley line formed by the 4th turn of the wire W2 and the 7th turn of the wire W1. Further, the 10th turn of the wire W1 is wound along a valley line formed by the 5th turns of the respective wires W1 and W2, and the 10th turn of the wire W2 is wound along a valley line formed by the 5th turn of the wire W2 and the 9th turn of the wire W1.

After that, the winding work is repeatedly performed under the same rule as for the winding work of the three turns including the above-described 8th to 10th turns. That is, by repeatedly forming a winding pattern including the i-th to (i-th+2) turns, the second winding structure having a regular winding structure can be obtained. Further, like the modified winding structure illustrated in FIG. 12, a configuration may be possible in which the 35th turn of each of the wires W1 and W2 is wound in the intermediate layer L2, and the 36th turn of each of the wires W1 and W2 is wound in the upper layer L3.

As described above, in the second winding structure as well, the same turns of the wires W1 and W2 are disposed in the same layer, and three consecutive turns of each of the wires W1 and W2 are disposed in mutually different layers. Thus, it is possible to prevent an increase of parasitic capacitance component. Specifically, in the second winding structure, a difference in turn number between adjacent turns is suppressed to 7 at maximum, so that an increase of parasitic capacitance component is suppressed, thus allowing an increase in resonance frequency.

Figure 13:
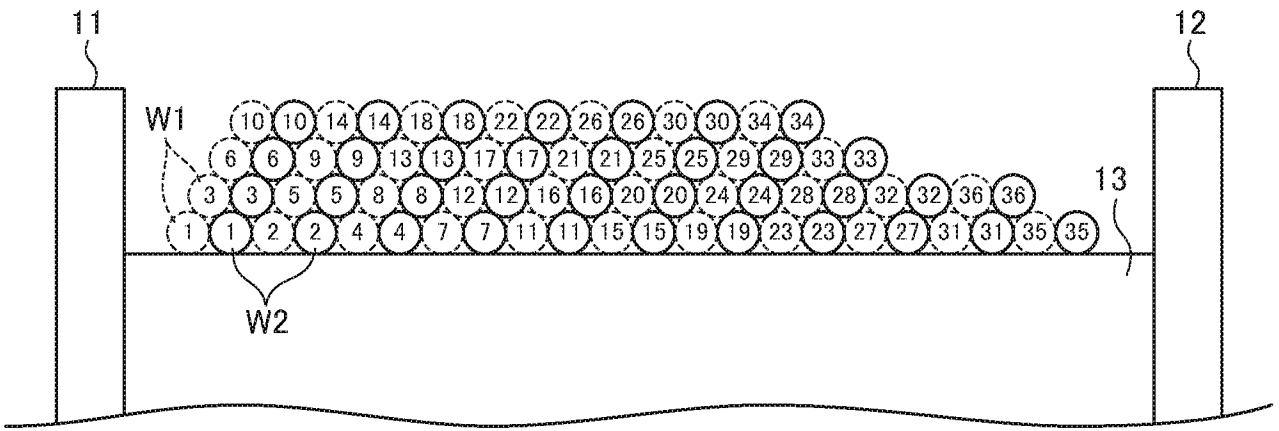
FIG. 13 is a schematic cross-sectional view for explaining a third winding structure of the wires.

FIG. 13 is a schematic cross-sectional view for explaining a third winding structure of the wires W1 and W2.

In the third winding structure illustrated in FIG. 13, the wires W1 and W2 constitute four winding layers on the winding core part 13. The four winding layers include, in order of proximity from the winding core part 13, a lower layer L1, a first intermediate layer L2*a*, a second intermediate layer L2*b* and an upper layer L3.

As illustrated in FIG. 13, the 1st, 2nd, 4th, 7th, 11th, 15th, 19th, 23rd, 27th, 31st and 35th turns of each of the wires W1 and W2 are wound in the lower layer L1, the 3rd, 5th, 8th, 12th, 16th, 20th, 24th, 28th, 32nd and 36th turns of each of the wires W1 and W2 are wound in the first intermediate layer L2*a*, the 6th, 9th, 13th, 17th, 21st, 25th, 29th and 33rd turns of each of the wires W1 and W2 are wound in the second intermediate layer L2*b*, and the 10th, 14th, 18th, 22nd, 26th, 30th and 34th turns of each of the wires W1 and W2 are wound in the upper layer L3. In this winding structure, turns of the respective wires W1 and W2 constituting a pair (turns having the same number) are adjacently disposed in mutually the same winding layer.

The turns wound in the first intermediate layer L2*a* are each wound along a valley line formed by two adjacent turns wound in the lower layer L1. Similarly, the turns wound in the second intermediate layer L2*b* are each wound along a valley line formed by two adjacent turns wound in the first intermediate layer L2*a*. Further, the turns wound in the upper layer L3 are each wound along a valley line formed by two adjacent turns wound in the second intermediate layer L2*b*. Specifically, the 12th, 16th, 20th, 24th, 28th, 32nd and 36th turns of the wire W1 wound in the first intermediate layer L2*a* are each wound along a valley line formed by a turn of the wire W1 wound in the lower layer L1 whose turn number is smaller by 5 therethan and a turn of the wire W2 wound in the lower layer L1 whose turn number is smaller by 5 therethan, and the 12th, 16th, 20th, 24th, 28th, 32nd and 36th turns of the wire W2 wound in the first intermediate layer L2*a* are each wound along a valley line formed by a turn of the wire W2 wound in the lower layer L1 whose turn number is smaller by 5 therethan and a turn of the wire W1 wound in the lower layer L1 whose turn number is smaller by 1 therethan. Further, the 13th, 17th, 21st, 25th, 29th and 33rd turns of the wire W1 wound in the second intermediate layer L2*b* are each wound along a valley line formed by a turn of the wire W1 wound in the first intermediate layer L2*a* whose turn number is smaller by 5 therethan and a turn of the wire W2 wound in the first intermediate layer L2*a* whose turn number is smaller by 5 therethan, and the 13th, 17th, 21st, 25th, 29th and 33rd turns of the wire W2 wound in the second intermediate layer L2*b* are each wound along a valley line formed by a turn of the wire W2 wound in the first intermediate layer L2*a* whose turn number is smaller by 5 therethan and a turn of the wire W1 wound in the first intermediate layer L2*a* whose turn number is smaller by 1 therethan. Further, the 14th, 18th, 22nd, 26th, 30th and 34th turns of the wire W1 wound in the upper layer L3 are each wound along a valley line formed by a turn of the wire W1 wound in the second intermediate layer L2*b* whose turn number is smaller by 5 therethan and a turn of the wire W2 wound in the second intermediate layer L2*b* whose turn number is smaller by 5 therethan, and the 14th, 18th, 22nd, 26th, 30th and 34th turns of the wire W2 wound in the upper layer L3 are each wound along a valley line formed by a turn of the wire W2 wound in the second intermediate layer L2*b* whose turn number is smaller by 5 therethan and a turn of the wire W1 wound in the second intermediate layer L2*b* whose turn number is smaller by 1 therethan.

More generally, the i-th turn (i is an integer equal to or larger than 1) of each of the wires W1 and W2 is wound in the lower layer L1, (i-th+1) turn of each of the wires W1 and W2 is wound in the first intermediate layer L2*a*, (i-th+2) turn of each of the wires W1 and W2 is wound in the second intermediate layer L2*b*, and (i-th+3) turn of each of the wires W1 and W2 is wound in the upper layer L3. Further, (i-th+5) turn of the wire W1 is wound along a valley line formed by the i-th turn of the wire W1 and the i-th turn of the wire W2, and (i-th+5) turn of the wire W2 is wound along a valley line formed by (i-th+4) turn of the wire W1 and the i-th turn of the wire W2. Further, (i-th+6) turn of the wire W1 is wound along a valley line formed by (i-th+1) turn of the wire W1 and (i-th+1) turn of the wire W2, and (i-th+6) turn of the wire W2 is wound along a valley line formed by (i-th+5) turn of the wire W1 and (i-th+1) turn of the wire W2. Furthermore, (i-th+7) turn of the wire W1 is wound along a valley line formed by (i-th+2) turn of the wire W1 and (i-th+2) turn of the wire W2, and (i-th+7) turn of the wire W2 is wound along a valley line formed by (i-th+6) turn of the wire W1 and (i-th+2) turn of the wire W2.

A method for obtaining the third winding structure illustrated in FIG. 13 is as follows. First, the method described using FIGS. 7 and 8 is used to wind the 1st to 6th turns of each of the wires W1 and W2. The 1st to 6th turns of the wires W1 and those of the wire W2 collectively constitute a wall for properly winding the 7th and subsequent turns of each of the wires W1 and W2 so as to prevent collapse of the winding.

Figure 14:
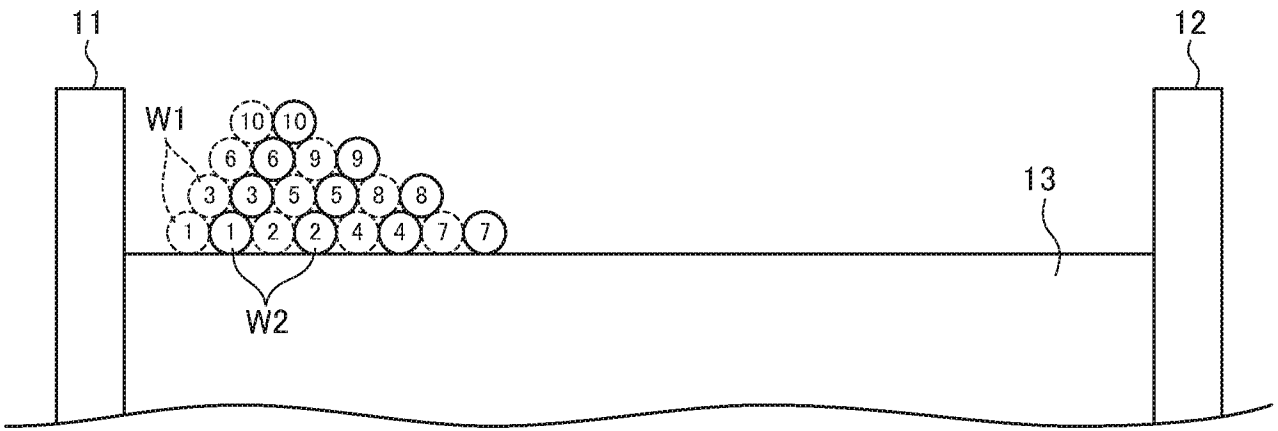
FIG. 14 is a schematic process diagrams for explaining a method for obtaining the third winding structure.

Then, as illustrated in FIG. 14, the 7th turns of the respective wires W1 and W2 are wound side by side with the 4th turns thereof in the lower layer L1. Subsequently, the 8th turn of the wire W1 is wound along a valley line formed by the 4th turns of the respective wires W1 and W2, and the 8th turn of the wire W2 is wound along a valley line formed by the 4th turn of the wire W2 and the 7th turn of the wire W1. Further, the 9th turn of the wire W1 is wound along a valley line formed by the 5th turns of the respective wires W1 and W2, and the 9th turn of the wire W2 is wound along a valley line formed by the 5th turn of the wire W2 and the 8th turn of the wire W1. Furthermore, the 10th turn of the wire W1 is wound along a valley line formed by the 6th turns of the respective wires W1 and W2, and the 10th turn of the wire W2 is wound along a valley line formed by the 6th turn of the wire W2 and the 9th turn of the wire W1.

After that, the winding work is repeatedly performed under the same rule as for the winding work of the four turns including the above-described 7th to 10th turns. That is, by repeatedly forming a winding pattern including the i-th to (i-th+3) turns, the third winding structure having a regular winding structure can be obtained.

As described above, in the third winding structure, the same turns of the wires W1 and W2 are disposed in the same layer, and four consecutive turns of each of the wires W1 and W2 are disposed in mutually different layers. Thus, it is possible to prevent an increase of parasitic capacitance component. Specifically, in the third winding structure, a difference in turn number between adjacent turns is suppressed to 5 at maximum, so that an increase of parasitic capacitance component is suppressed, thus allowing an increase in resonance frequency. In addition, the wires W1 and W2 constitute four winding layers, thus making it possible to further reduce the axial length of the winding core part 13.

Figure 15:
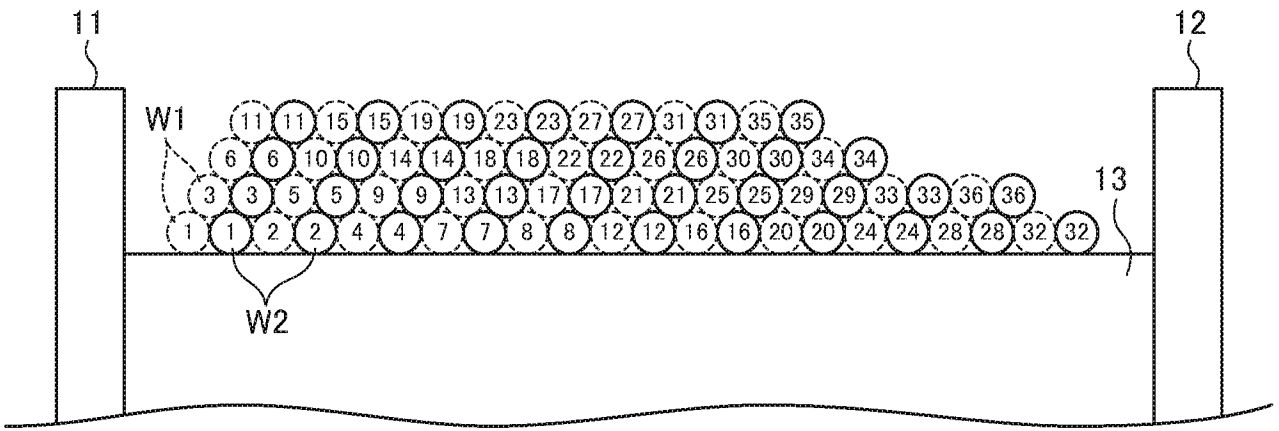
FIG. 15 is a schematic cross-sectional view for explaining a fourth winding structure of the wires.

FIG. 15 is a schematic cross-sectional view for explaining a fourth winding structure of the wires W1 and W2.

In the fourth winding structure illustrated in FIG. 15, the wires W1 and W2 constitute four winding layers on the winding core part 13 as in the third winding structure.

As illustrated in FIG. 15, the 1st, 2nd, 4th, 7th, 8th, 12th, 16th, 20th, 24th, 28th and 32nd turns of each of the wires W1 and W2 are wound in the lower layer L1, the 3rd, 5th, 9th, 13th, 17th, 21st, 25th, 29th, 33rd and 36th turns of each of the wires W1 and W2 are wound in the first intermediate layer L2*a*, the 6th, 10th, 14th, 18th, 22nd, 26th, 30th and 34th turns of each of the wires W1 and W2 are wound in the second intermediate layer L2*b*, and the 11th, 15th, 19th, 23rd, 27th, 31st and 35th turns of each of the wires W1 and W2 are wound in the upper layer L3. In this winding structure, turns of the respective wires W1 and W2 constituting a pair (turns having the same number) are adjacently disposed in mutually the same winding layer.

The turns wound in the first intermediate layer L2*a* are each wound along a valley line formed by two adjacent turns wound in the lower layer L1. Similarly, the turns wound in the second intermediate layer L2*b* are each wound along a valley line formed by two adjacent turns wound in the first intermediate layer L2*a*. Further, the turns wound in the upper layer L3 are each wound along a valley line formed by two adjacent turns wound in the second intermediate layer L2*b*.

Specifically, the 17th, 21st, 25th, 29th and 33rd turns of the wire W1 wound in the first intermediate layer L2*a* are each wound along a valley line formed by a turn of the wire W1 wound in the lower layer L1 whose turn number is smaller by 9 therethan and a turn of the wire W2 wound in the lower layer L1 whose turn number is smaller by 9 therethan, and the 17th, 21st, 25th, 29th and 33rd turns of the wire W2 wound in the first intermediate layer L2*a* are each wound along a valley line formed by a turn of the wire W2 wound in the lower layer L1 whose turn number is smaller by 9 therethan and a turn of the wire W1 wound in the lower layer L1 whose turn number is smaller by 5 therethan. Further, the 10th, 14th, 18th, 22nd, 26th, 30th and 34th turns of the wire W1 wound in the second intermediate layer L2*b* are each wound along a valley line formed by a turn of the wire W1 wound in the first intermediate layer L2*a* whose turn number is smaller by 5 therethan and a turn of the wire W2 wound in the first intermediate layer L2*a* whose turn number is smaller by 5 therethan, and the 18th, 22nd, 26th, 30th and 34th turns of the wire W2 wound in the second intermediate layer L2*b* are each wound along a valley line formed by a turn of the wire W2 wound in the first intermediate layer L2*a* whose turn number is smaller by 5 therethan and a turn of the wire W1 wound in the first intermediate layer L2*a* whose turn number is smaller by 1 therethan. Further, the 11th, 15th, 19th, 23rd, 27th, 31st and 35th turns of the wire W1 wound in the upper layer L3 are each wound along a valley line formed by a turn of the wire W1 wound in the second intermediate layer L2*b* whose turn number is smaller by 5 therethan and a turn of the wire W2 wound in the second intermediate layer L2*b* whose turn number is smaller by 5 therethan, and the 11th, 15th, 19th, 23rd, 27th, 31st and 35th turns of the wire W2 wound in the upper layer L3 are each wound along a valley line formed by a turn of the wire W2 wound in the second intermediate layer L2*b* whose turn number is smaller by 5 therethan and a turn of the wire W1 wound in the second intermediate layer L2*b* whose turn number is smaller by 1 therethan.

More generally, the i-th turn (i is an integer equal to or larger than 1) of each of the wires W1 and W2 is wound in the lower layer L1, (i-th+1) turn of each of the wires W1 and W2 is wound in the first intermediate layer L2*a*, (i-th+2) turn of each of the wires W1 and W2 is wound in the second intermediate layer L2*b*, and (i-th+3) turn of each of the wires W1 and W2 is wound in the upper layer L3. Further, (i-th+9) turn of the wire W1 is wound along a valley line formed by the i-th turn of the wire W1 and the i-th turn of the wire W2, and (i-th+9) turn of the wire W2 is wound along a valley line formed by (i-th+4) turn of the wire W1 and the i-th turn of the wire W2. Further, (i-th+6) turn of the wire W1 is wound along a valley line formed by (i-th+1) turn of the wire W1 and (i-th+1) turn of the wire W2, and (i-th+6) turn of the wire W2 is wound along a valley line formed by (i-th+5) turn of the wire W1 and (i-th+1) turn of the wire W2. Furthermore, (i-th+7) turn of the wire W1 is wound along a valley line formed by (i-th+2) turn of the wire W1 and (i-th+2) turn of the wire W2, and (i-th+7) turn of the wire W2 is wound along a valley line formed by (i-th+6) turn of the wire W1 and (i-th+2) turn of the wire W2.

A method for obtaining the fourth winding structure illustrated in FIG. 15 is as follows. First, the method described using FIG. 10 is used to wind the 1st to 7th turns of each of the wires W1 and W2. The 1st to 7th turns of the wires W1 and those of the wire W2 collectively constitute a wall for properly winding the 8th and subsequent turns of each of the wires W1 and W2 so as to prevent collapse of the winding. In the fourth winding structure, in the turns constituting the wall, the number of turns wound in the lower layer L1 is larger by 4 than the number of turns wound in the intermediate layer L2, so that collapse of the winding is less likely to occur in the subsequent winding work.

Figure 16:
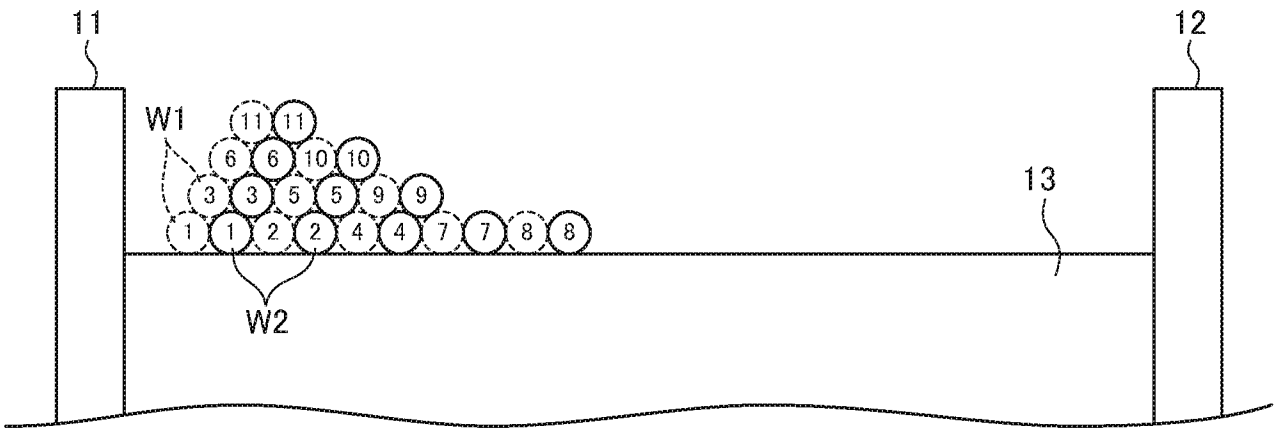
FIG. 16 is a schematic process diagrams for explaining a method for obtaining the fourth winding structure.

Then, as illustrated in FIG. 16, the 8th turns of the respective wires W1 and W2 are wound side by side with the 7th turns thereof in the lower layer L1. Subsequently, the 9th turn of the wire W1 is wound along a valley line formed by the 4th turns of the respective wires W1 and W2, and the 9th turn of the wire W2 is wound along a valley line formed by the 4th turn of the wire W2 and the 7th turn of the wire W1. Further, the 10th turn of the wire W1 is wound along a valley line formed by the 5th turns of the respective wires W1 and W2, and the 10th turn of the wire W2 is wound along a valley line formed by the 5th turn of the wire W2 and the 9th turn of the wire W1. Furthermore, the 11th turn of the wire W1 is wound along a valley line formed by the 6th turns of the respective wires W1 and W2, and the 11th turn of the wire W2 is wound along a valley line formed by the 6th turn of the wire W2 and the 10th turn of the wire W1.

After that, the winding work is repeatedly performed under the same rule as for the winding work of the four turns including the above-described 8th to 11th turns. That is, by repeatedly forming a winding pattern including i-th to (i-th+3) turns, the third winding structure having a regular winding structure can be obtained.

As described above, in the fourth winding structure as well, the same turns of the wires W1 and W2 are disposed in the same layer, and four consecutive turns of each of the wires W1 and W2 are disposed in mutually different layers. Thus, it is possible to prevent an increase of parasitic capacitance component. Specifically, in the fourth winding structure, a difference in turn number between adjacent turns is suppressed to 9 at maximum, so that an increase of parasitic capacitance component is suppressed, thus allowing an increase in resonance frequency. In addition, the wires W1 and W2 constitute four winding layers, thus making it possible to further reduce the axial length of the winding core part 13.

Figure 17:
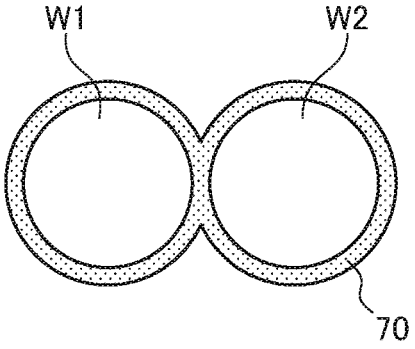
FIG. 17 is a schematic cross-sectional view of a paired wire.

As described above, in the present embodiment, the paired turns of the respective wires W1 and W2 are adjacently disposed in mutually the same winding layer, so that winding work is made easier than when the same turns of the wires W1 and W2 are disposed in mutually different winding layers. Further, as illustrated in FIG. 17, a paired wire integrally formed through an insulating body 70 may be used as the wires W1 and W2.

It is apparent that the present invention is not limited to the above embodiments, but may be modified and changed without departing from the scope and spirit of the invention.

While, for example, all the paired turns of the wires W1 and W2 are disposed in mutually the same winding layer in the above embodiment, some paired turns may be disposed in mutually different winding layer.

What is claimed is:

1. A coil component comprising:

a winding core part; and first and second wires wound around the winding core part, wherein the first and second wires constitute at least three winding layers on the winding core part, and wherein an i-th (i is an integer equal to or larger than 4) turn, an (i+1) turn, and an (i+2) turn of each of the first and second wires are positioned in mutually different winding layers, wherein the first and second wires constitute three winding layers including, in order of proximity from the winding core part, a lower layer, an intermediate layer, and an upper layer, wherein the i-th turn of each of the first and second wires are wound in the lower layer, wherein the (i-th+1) turn of each of the first and second wires are wound in the intermediate layer, wherein the (i-th+2) turn of each of the first and second wires are wound in the upper layer, wherein an (i-th+4) turn of the first wire is wound along a valley line formed by the i-th turn of the first wire and the i-th turn of the second wire, and wherein an (i-th+5) turn of the first wire is wound along a valley line formed by the (i-th+1) turn of the first wire and the (i-th+1) turn of the second wire.

2. The coil component as claimed in claim 1, wherein an (i-th+4) turn of the second wire is wound along a valley line formed by an (i-th+3) turn of the first wire and the i-th turn of the second wire, and wherein an (i-th+5) turn of the second wire is wound along a valley line formed by an (i-th+4) turn of the first wire and the (i-th+1) turn of the second wire.

3. The coil component as claimed in claim 1, wherein the first and second wires constitute four winding layers including, in order of proximity from the winding core part, a lower layer, a first intermediate layer, a second intermediate layer, and an upper layer, wherein the i-th turn of each of the first and second wires are wound in the lower layer, wherein the (i-th+1) turn of each of the first and second wires are wound in the first intermediate layer, wherein the (i-th+2) turn of each of the first and second wires are wound in the second intermediate layer, and wherein a (i-th+3) turn of each of the first and second wires are wound in the upper layer.

4. The coil component as claimed in claim 3, wherein a (i-th+5) turn of the first wire is wound along a valley line formed by the i-th turn of the first wire and the i-th turn of the second wire, wherein a (i-th+6) turn of the first wire is wound along a valley line formed by the (i-th+1) turn of the first wire and the (i-th+1) turn of the second wire, and wherein a (i-th+7) turn of the first wire is wound along a valley line formed by the (i-th+2) turn of the first wire and the (i-th+2) turn of the second wire.

5. The coil component as claimed in claim 4, wherein a (i-th+5) turn of the second wire is wound along a valley line formed by a (i-th+4) turn of the first wire and the i-th turn of the second wire, wherein a (i-th+6) turn of the second wire is wound along a valley line formed by the (i-th+5) turn of the first wire and the (i-th+1) turn of the second wire, and wherein a (i-th+7) turn of the second wire is wound along a valley line formed by the (i-th+6) turn of the first wire and the (i-th+2) turn of the second wire.

6. The coil component as claimed in claim 3, wherein a (i-th+9) turn of the first wire is wound along a valley line formed by the i-th turn of the first wire and the i-th turn of the second wire, wherein a (i-th+6) turn of the first wire is wound along a valley line formed by the (i-th+1) turn of the first wire and the (i-th+1) turn of the second wire, and wherein a (i-th+7) turn of the first wire is wound along a valley line formed by the (i-th+2) turn of the first wire and the (i-th+2) turn of the second wire.

7. The coil component as claimed in claim 6, wherein a (i-th+9) turn of the second wire is wound along a valley line formed by a (i-th+4) turn of the first wire and the i-th turn of the second wire, wherein a (i-th+6) turn of the second wire is wound along a valley line formed by the (i-th+5) turn of the first wire and the (i-th+1) turn of the second wire, and wherein a (i-th+7) turn of the second wire is wound along a valley line formed by the (i-th+6) turn of the first wire and the (i-th+2) turn of the second wire.

8. The coil component as claimed in claim 1, further comprising:

a flange part; and a terminal electrode provided on the flange part and connected with one ends of the first and second wires, wherein the one ends of the first and second wires are short-circuited through the terminal electrode.

9. A coil component comprising:

a winding core part; and first and second wires wound around the winding core part, wherein the first and second wires constitute at least three winding layers on the winding core part, and wherein an i-th (i is an integer equal to or larger than 4) turn, an (i+1) turn, and an (i+2) turn of each of the first and second wires are positioned in mutually different winding layers, wherein the first and second wires constitute three winding layers including, in order of proximity from the winding core part, a lower layer, an intermediate layer, and an upper layer, wherein the i-th turn of each of the first and second wires are wound in the lower layer, wherein the (i-th+1) turn of each of the first and second wires are wound in the intermediate layer, wherein the (i-th+2) turn of each of the first and second wires are wound in the upper layer, wherein an (i-th+7) turn of the first wire is wound along a valley line formed by the i-th turn of the first wire and the i-th turn of the second wire, and wherein an (i-th+5) turn of the first wire is wound along a valley line formed by the (i-th+1) turn of the first wire and the (i-th+1) turn of the second wire.

10. The coil component as claimed in claim 9, wherein an (i-th+7) turn of the second wire is wound along a valley line formed by an (i-th+3) turn of the first wire and the i-th turn of the second wire, and wherein an (i-th+5) turn of the second wire is wound along a valley line formed by an (i-th+4) turn of the first wire and the (i-th+1) turn of the second wire.

* * * * *